US007325597B2

(12) United States Patent
Ringgenberg et al.

(10) Patent No.: US 7,325,597 B2
(45) Date of Patent: Feb. 5, 2008

(54) SAFETY VALVE APPARATUS FOR DOWNHOLE PRESSURE TRANSMISSION SYSTEMS

(75) Inventors: Paul D. Ringgenberg, Frisco, TX (US); Jose Sierra, Katy, TX (US)

(73) Assignee: WellDynamics, B.V., Leiderdorp (NL)

( * ) Notice: Subject to any disclaimer, the term of this patent is extended or adjusted under 35 U.S.C. 154(b) by 318 days.

(21) Appl. No.: 11/182,641

(22) Filed: Jul. 15, 2005

(65) Prior Publication Data

US 2007/0012434 A1 Jan. 18, 2007

(51) Int. Cl.
*E21B 49/08* (2006.01)

(52) U.S. Cl. ..... 166/66; 73/152.51; 166/250.07

(58) Field of Classification Search ..... 166/66, 166/250.07; 73/152.51, 152.52
See application file for complete search history.

(56) References Cited

U.S. PATENT DOCUMENTS 3,633,414 A * 1/1972 Field et al. ..... 73/152.51
3,744,307 A * 7/1973 Harper et al. ..... 73/152.51
3,895,527 A 7/1975 McArthur
3,898,877 A 8/1975 McArthur
3,985,027 A * 10/1976 Tricon ..... 73/152.51
4,010,642 A 3/1977 McArthur
4,018,088 A * 4/1977 McArthur ..... 73/152.51
4,505,155 A 3/1985 Jackson
4,678,035 A * 7/1987 Goldschild ..... 166/250.07
4,976,142 A 12/1990 Perales
5,163,321 A 11/1992 Perales
5,184,508 A * 2/1993 Desbrandes ..... 73/152.05

OTHER PUBLICATIONS

Air Products Tutorial, What Are Membranes; 2 pgs; as early as 1996.

* cited by examiner

*Primary Examiner*—Hoang Dang
(74) *Attorney, Agent, or Firm*—Smith IP Services, P.C.

(57) ABSTRACT

Safety valve apparatus for a pressure telemetry system utilizing a small diameter tubing conveying pressure from a downhole pressure chamber to the surface, the system pressurized with a monitoring gas, is presented. A check valve assembly is placed along the fluid flow path having a check valve with an operating member. The operating member moves to a sealed position by floating on an activating fluid. The operating member must be of low effective specific gravity to float on wellbore hydrocarbon fluids, either liquid or gas. Consequently, in one preferred embodiment, the check valve operating member is a hollow dart which retains the monitoring gas inside the hollow portion, thereby effectively reducing its specific gravity such that it will float on the activating fluid. The activating fluid is a fluid can be hydrocarbon wellbore liquid or gas, completion, stimulation or other injected liquids or gases or an activating liquid or gas stored in a separate chamber in fluid communication with the check valve chamber.

31 Claims, 11 Drawing Sheets

SAFETY VALVE APPARATUS FOR DOWNHOLE PRESSURE TRANSMISSION SYSTEMS

CROSS-REFERENCE TO RELATED APPLICATIONS

None

STATEMENT REGARDING FEDERALLY SPONSORED RESEARCH OR DEVELOPMENT

None

REFERENCE TO MICROFICHE APPENDIX

Not applicable

TECHNICAL FIELD

The present invention relates to techniques for monitoring pressure at a downhole location within an oil, gas or other hydrocarbon wellbore. More particularly, the present invention is directed to a safety valve apparatus for downhole pressure transmission systems.

BACKGROUND OF INVENTION

The accurate measurement of downhole fluid pressure and temperature in a borehole has long been recognized as being important in the production of oil, gas, and/or geothermal energy. Accurate pressure and temperature measurements are important in maximizing the efficiency of a well and may indicate problems in oil recovery operations. Both secondary hydrocarbon recovery operations and geothermal operations typically require pressure and temperature information to determine various factors considered useful in predicting the success of the operation, and in obtaining the maximum recovery of energy from the borehole.

In secondary hydrocarbon recovery operations, accurate borehole pressure specifically give an indication of well productivity potential, and allow the operator to predict the amount of fluid that should be required to fill the formation before oil or gas can be expected to be forced out from the formation into the borehole and then recovered to the surface. The accurate measurement of pressure and temperature changes in well fluids from each of various boreholes extending into a formation may indicate the location of injection fluid fronts, as well as the efficiency with which the fluid front is sweeping the formation. In geothermal wells, accurate pressure and temperature information is critical to efficient production due to the potential damage which occurs if reinjected fluids cool the formation or changes in fluid dynamics cause well bore plugging.

Techniques have been devised for providing a periodic measurement of downhole conditions by lowering sensors into the borehole at desired times, although such periodic measurement techniques are both inconvenient and expensive due to the time and expense normally required to insert instrumentation into the borehole. Any such periodic measurement technique is limited in that it provides only a representation of borehole conditions at specific times, and does not provide the desired information over a substantial length of time which is typically desired by the operator.

Permanent installation techniques have been devised for continually monitoring pressure in a borehole in a manner which overcomes the inherent problems associated with periodic measurement. One such prior art technique employs a downhole pressure transducer and a temperature sensor having electronic scanning ability for converting detected downhole pressures and temperatures into electronic data, which then are transmitted to the surface on a conductor line. The conductor line is normally attached to the outside of the tubing in the wellbore, and the transducer and temperature sensor are conveniently mounted on the lower end of the production tubing. This system has shortcomings, however, in part because of the expense and high maintenance required for the electronics positioned in the hostile wellbore environment over an extended period of time. The high temperatures, pressures and/or corrosive fluids in the wellbore substantially increase the expense and decrease the reliability of the downhole electronics. Downhole pressure transducers and temperature sensors which output electronic data for transmission to the surface are generally considered delicate systems, and thus are not favored in the hostile environments which normally accompany a downhole wellbore.

Overcoming these problems, a system for downhole pressure measurement was devised utilizing a small diameter capillary tube or microtube connected to a downhole pressure chamber. The pressure chamber is in fluid communication with the fluid pressure in the well. The small diameter tubing transmits the pressure from the downhole location to the surface where pressure measurement using conventional or electronic pressure gauges is possible in a friendlier environment. These systems are sometimes referred to as Pressure Telemetry Systems or Molecular Telemetry Systems. Typically a monitoring gas, such as helium or nitrogen, used. U.S. Pat. No. 3,895,527, issued to McArthur, incorporated herein by reference for all purposes, discloses a system for remotely measuring pressure in a borehole which utilizes a small diameter tube which has one end exposed to borehole pressure and has its other end connected to a pressure gauge or other detector at the surface.

The concept of measuring downhole pressure according to a system which uses such a small diameter tube is also disclosed in U.S. Pat. No. 3,898,877, issued to McArthur, and an improved version of such a system is disclosed in U.S. Pat. No. 4,010,642, also issued to McArthur, both of which are incorporated herein by reference for all purposes. The teachings of this latter patent have rendered this technology particularly well suited for more reliably measuring pressure in a borehole, since the lower end of the tube extends into a chamber having at least a desired volume. Further methods are found in U.S. Pat. No. 4,505,155 to Jackson, incorporated herein by reference for all purposes. U.S. Pat. No. 4,018,088 to McArthur teaches use of a downhole high pressure float valve in the chamber. Accurate downhole temperature readings in conjunction with pressure readings utilizing small diameter tubing pressure transmission are taught in U.S. Pat. Nos. 4,976,142 and 5,163,321, both issued to Perales and both incorporated herein for all purposes. Additional improvements have been made resulting in retrievable pressure telemetry systems, purging and system check techniques, simultaneous temperature measurement, advanced temperature and pressure measurement techniques, expandable chambers, continuous capillary tubing, capillary gas weight calculation to correct for truer bottom hole pressures, use of helium as the monitoring gas, concentric chambers, automatic purge systems and others. Pressure telemetry systems are commercially available from Halliburton Energy Services under the tradename EZ-Gauge.

One problem with the pressure telemetry systems is the lack of a device to stop hydrocarbon flow up the small diameter conduit in the case of failure of the system due to a leak of the monitoring gas or due to a catastrophic wellhead event. The continuous conduit of molecules to the surface is perfectly safe during normal operation, but can become a concern after catastrophic events. If the wellhead is severely damaged, such as after it is hit by a truck or other surface equipment, by a natural or man-made disaster, such as an iceberg, tsunami, hurricane, tornado, avalanche, earthquake, mudslide or military ordnance, the conduit can become a potential path for hydrocarbon to travel from the wellbore to the surface. Due to the extremely small diameter of the conduit, the surface leak will be small or even non-existent if the conduit becomes plugged, but the potential does exist for a leak. Whether the failure of the system is due to a catastrophic event or a leak in the conduit, wellbore fluid flows into the conduit where it can foul the small diameter tubing of the conduit.

Disadvantages of the prior art are overcome by the present invention, and improved methods and apparatus are hereinafter disclosed for reducing or eliminating the possibility of a surface leak after a catastrophic wellhead event and preventing movement of wellbore fluid into the small diameter tubing of a pressure telemetry system.

SUMMARY OF THE INVENTION

Safety valve apparatus for a pressure telemetry system, or a pressure monitoring system utilizing a small diameter tubing conveying pressure from a downhole pressure chamber to the surface, the system pressurized with a monitoring gas, is presented. A pressure measuring apparatus for continuously measuring pressure of a wellbore fluid in a wellbore at a downhole location has a conduit positioned in the wellbore and having a flow path extending from the surface to a downhole housing. The downhole housing defines a monitoring-gas chamber, the housing in fluid communication with the flow path in the conduit and with the wellbore. A pressurized monitoring-gas source is used for pressuring the flow path in the conduit and at least a portion of the monitoring-gas chamber with a selected monitoring gas.

In one embodiment, a check valve assembly is placed along the fluid flow path having a check valve housing defining a check valve chamber. An operating member is disposed within the check valve chamber and is movable between an open position wherein fluid communication between the wellbore and the surface along the flow path of the conduit is allowed and a sealed position wherein fluid communication between the wellbore and the surface along the flow path of the conduit is prevented. The operating member moves to the sealed position by floating on an activating fluid. The operating member must be of low effective specific gravity to float on wellbore hydrocarbon fluids, either liquid or gas. Consequently, in one preferred embodiment, the check valve operating member is a hollow dart which retains the monitoring gas inside the hollow portion, thereby effectively reducing its specific gravity such that it will float on the activating fluid. The activating fluid is a fluid can be hydrocarbon wellbore liquid or gas, completion, stimulation or other injected liquids or gases or an activating liquid or gas stored in a separate chamber in fluid communication with the check valve chamber. Preferably, the dart comprises at least a portion with a standoff member to assist in preventing the dart from sticking to the check valve chamber wall. The assembly may have a retaining member for limiting movement of the operating member away from the sealed position and may utilize a biasing mechanism to bias the member toward the open or closed position. The biasing mechanism can be gravity, a spring or other devices.

In another embodiment, the check valve assembly has a semi-permeable membrane creating a barrier across the check valve chamber. The semi-permeable membrane is substantially permeable to the monitoring gas and substantially impermeable to the activating fluid. For example, the semi-permeable membrane can be highly permeable to helium while being substantially impermeable to hydrocarbon gas. The sealing operating member of the valve is moved to the sealed position when the membrane is contacted by the activating fluid. A pressure differential is created across the semi-permeable membrane when it is contacted on one side by the activating fluid, such as hydrocarbon gas, and on the other side only by the monitoring gas. This pressure differential causes the membrane to expand or contract, depending on the particular design, and thereby move the operating member into the sealed position. In a particular design a membrane "balloon" is provided, which contracts upon contact by the activating fluid. As the balloon contracts, the operating member is forced into sealing contact with the chamber sealing surface.

In another embodiment, the check valve assembly operating member is moved to the sealed position by a swellable material, the swellable material substantially swelling when exposed to an activating fluid. The swellable material is positioned within the check valve assembly chamber and, when swollen, forces the operating member into the sealed position. Preferably the swellable material reduces to at or near its original unswelled size when the activating fluid is removed, such as by purging the system.

These and further objects, features, and advantages of the present invention will become apparent from the following detailed description, wherein references made to the figures in the accompanying drawings.

BRIEF DESCRIPTION OF THE DRAWINGS

The accompanying drawings are incorporated into and form a part of the specification to illustrate several examples of the present inventions. These drawings together with the description serve to explain the principles of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION OF PREFERRED EMBODIMENTS

The present invention has utility for reducing or eliminating the possibility of a surface leak after a catastrophic wellhead or other event in a wellbore having a pressure telemetry system utilizing a small diameter tubing extending from the surface of the well to a downhole test location. The downhole fluid pressure to be monitored may be monitored in flowing, pumping or static wells, and the downhole fluid may be equal or greater than hydrostatic pressure. For purposes of this of this description, the terms "up," "down," "uphole," "downhole," "top," and "bottom" and the like are for reference purposes only. The device can be used in a horizontal or deviated well, and practitioners will recognize that some of the parts of the device can be rotated or reversed in orientation or order.

Figure 1:
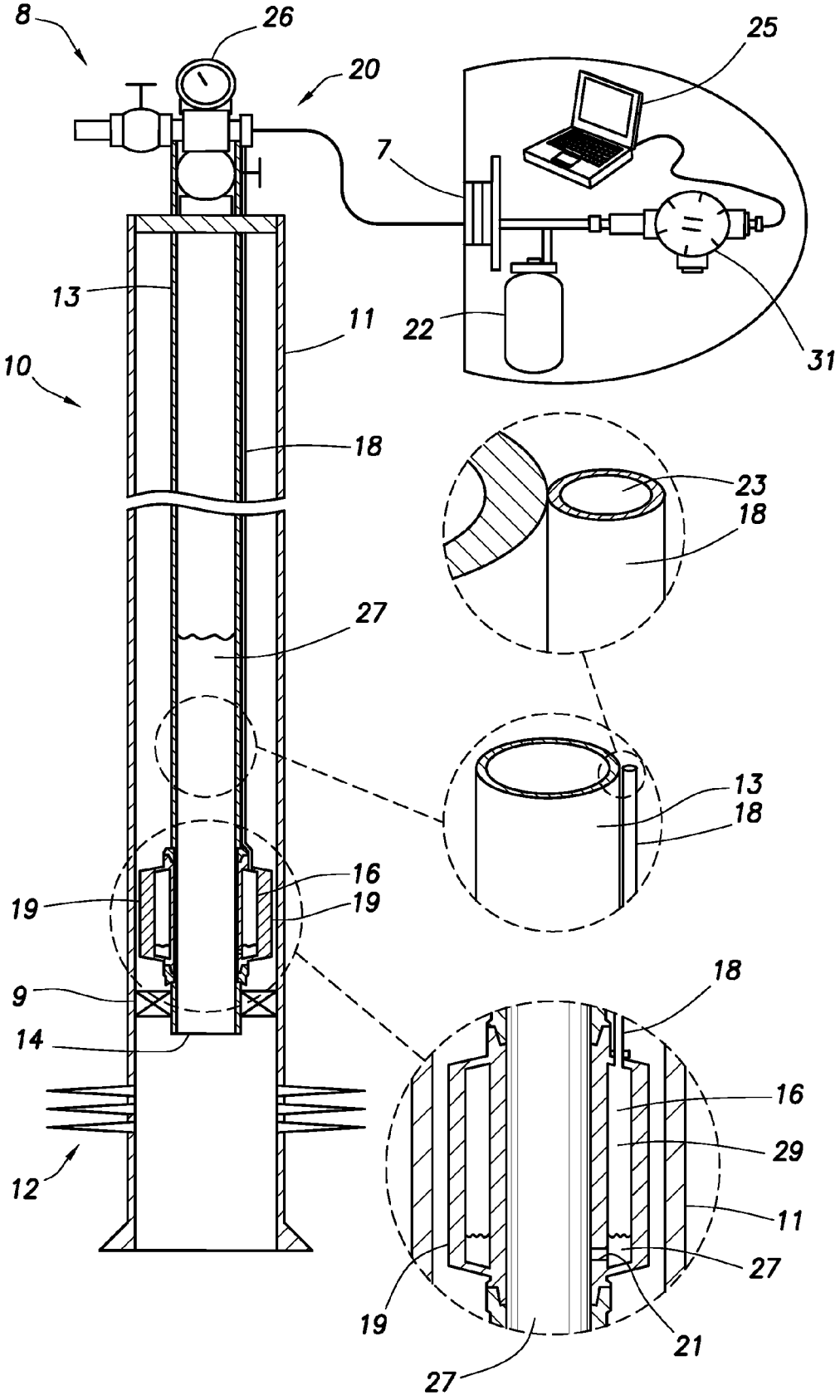
FIG. 1 is a pictorial view, partially in cross-section, of the pressure monitoring system in a wellbore of a producing hydrocarbon well with various exploded detailed sections.

FIG. 1 illustrates a typical wellbore 10 extending into underground formation. FIG. 1 illustrates a producing well, and production equipment, including a conventional wellhead 8 at the surface and packers 9 in the wellbore, are shown. Other equipment may be used in conjunction with the invention. A casing 11 is positioned in the wellbore 10, and has perforations 12 at its lower end to permit the entry of fluid from the formation into the casing 11. Production tubing string 13 extends from the wellhead 8 at the surface to a selected depth in the wellbore 10. An access 14 to the tubing string 13 allows fluid in the casing 11 to enter the production tubing and then to flow to the surface. The access 14 can be through the bottom of the tubing string, as shown, or through perforations in the string or through a screen or by other known device. A small diameter continuous conduit 18 runs along and may be attached to the tubing string 13. Alternately, the conduit may be separate from the string, lowered on a wireline or otherwise introduced to the wellbore. A monitoring-gas housing 19 is provided at the lower end of the production tubing 13, and includes a chamber 16 having ports 21 for maintaining fluid communication between the chamber 16 and the fluid in the wellbore 10. The ports 21 may provide fluid communication to the interior of the tubing string 13 or to the annular space between the tubing string 13 and the casing 11, depending on which pressure is desired to be monitored. Further, the chamber, which is in fluid communication with the wellbore, can be directly ported to the wellbore fluids in the tubing interior, as shown, directly ported to the annular space between the casing and tubing or indirectly ported through various ports and conduits.

The small diameter conduit 18 extends from the surface to a downhole location where monitoring-gas housing 19 is located. The conduit 18 may be run inside of the production tubing 13, outside the tubing 13, as shown, or independently on a wireline or conduit spool or outside the casing. The lower end of the conduit 18 is in fluid communication with the chamber 16. Suitable small diameter tubing may vary in diameter according to the specific parameters of the well and well conditions, but is typically 0.125" or 0.250" in outer diameter with an 0.035" or 0.152" internal diameter, respectively. Temperature monitoring equipment (not shown) may also be utilized, such as a thermocouple or fiber optic line, inside or outside the conduit and thermal sensors. As those skilled in the art appreciate, small diameter tubing in the range as specified above is commonly referred to as microtubing.

FIG. 1 also indicates that the conduit 18 extends to the surface of the well. The manifold 20 has a fluid exit port that effectively provides for a continuation of the tube to a surface valve 7, which in turn may be connected to a pressurized monitoring fluid source 22, for supplying monitoring gas 29, and to a pressure measuring device 31. A computer 25 and other surface equipment 26 for measuring, calibrating, monitoring, controlling, tracking, etc. of the monitoring fluid supply and pressure reading equipment can also be utilized. The monitoring fluid 29 is typically a gas, most usually helium or nitrogen. Other fluids may be used, as are known in the art. The pressurized monitoring gas 29 is used to fill the flow path 23 of the conduit 18 and at least a portion of the monitoring-gas chamber 16. The monitoring-gas chamber 19 may be partially filled with hydrocarbon fluid 27, as shown, or entirely filled with monitoring gas. The hydrocarbon fluid 27 can be either liquid, such as oil, or gaseous, such as hydrocarbon gas, or a mixture of the fluids and other produced wellbore fluids. Alternately, the wellbore fluid may be a fluid injected or otherwise introduced into the wellbore during completion processes, such as completion or stimulation fluids.

Figure 2:
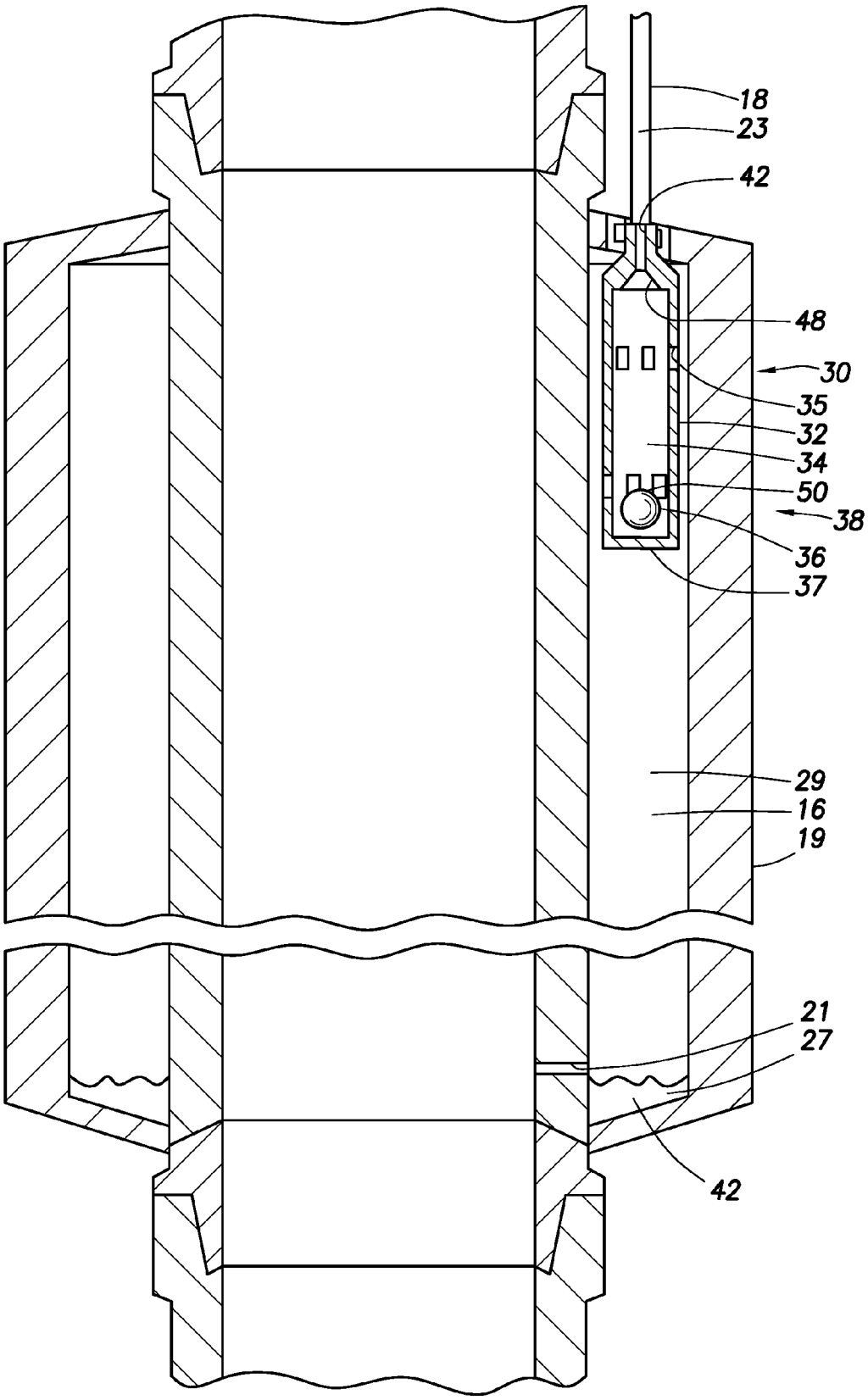
FIG. 2 is a cross-sectional view of the check valve assembly of the invention in an open position in monitoring-gas chamber attached to the exterior of a production tubing.

FIG. 2 shows a cross-sectional schematic view of a housing 19 with a monitoring-gas chamber 16 attached to the exterior of a production tubing 13. The chamber 16 is an annular volume defined by the exterior of the tubing 13 and the interior of the housing 19. Alternately, the monitoring-gas chamber can be independent of the tubing and can be of any shape or size. In some cases, the chamber is expandable. Where the chamber is annular, surrounding the tubing string or other tubular, it may be of considerable length, such as over 25 feet long, to provide adequate chamber volume. The length, shape and volume of the chamber may be provided as needed for various well parameters.

A safety check valve assembly 30 is provided at the top of the monitoring-gas chamber 16. The assembly can alternately be provided above or below the assembly. In another alternative, the assembly can be provided anywhere along the flow path 23 of the conduit 18 above the pressure monitoring housing 19. The check valve assembly 30 has a housing 32 defining a check valve chamber 34. The check valve chamber 34 is in fluid communication, in this case, through ports 35, with the monitoring-gas chamber 16. The check valve chamber 34 is in fluid communication, via the ports 35 and monitoring-gas chamber 16, with the activating fluid 42, in this case wellbore fluid 27. The check valve chamber 34 is also in fluid communication through port 42 to the flow path 23 of conduit 18. The check valve assembly includes an operating member 36 disposed within the check valve chamber 34 and movable between an open position 38, seen in FIG. 2, and a closed position 40, seen in FIG. 4. The operating member 36 is retained in a position near the closed position 40 by retaining member 37, which may be solid or have ports or flow passages therethrough, or may be a simple bar.

In FIG. 2, the operating member 36 is in the open position 38 and fluid flow is possible between the chamber 16, through the check valve chamber 34, into the flow path 23 of conduit 18 and to the surface. The check valve is normally in this configuration and monitoring gas 29 is pressurized into the flow path 23 and monitoring-gas chamber 16. Similarly, the pressure monitoring system transfers, through the fluid flow path described, the downhole pressure to be measured to the surface pressure measuring equipment. It is only when the wellbore pressure exceeds the pressure of the monitoring gas, such as when there is a leak in the monitoring gas system or catastrophic event at the wellhead, that the check valve will move to a closed position preventing fluid flow to the surface from the wellbore.

Figure 3:
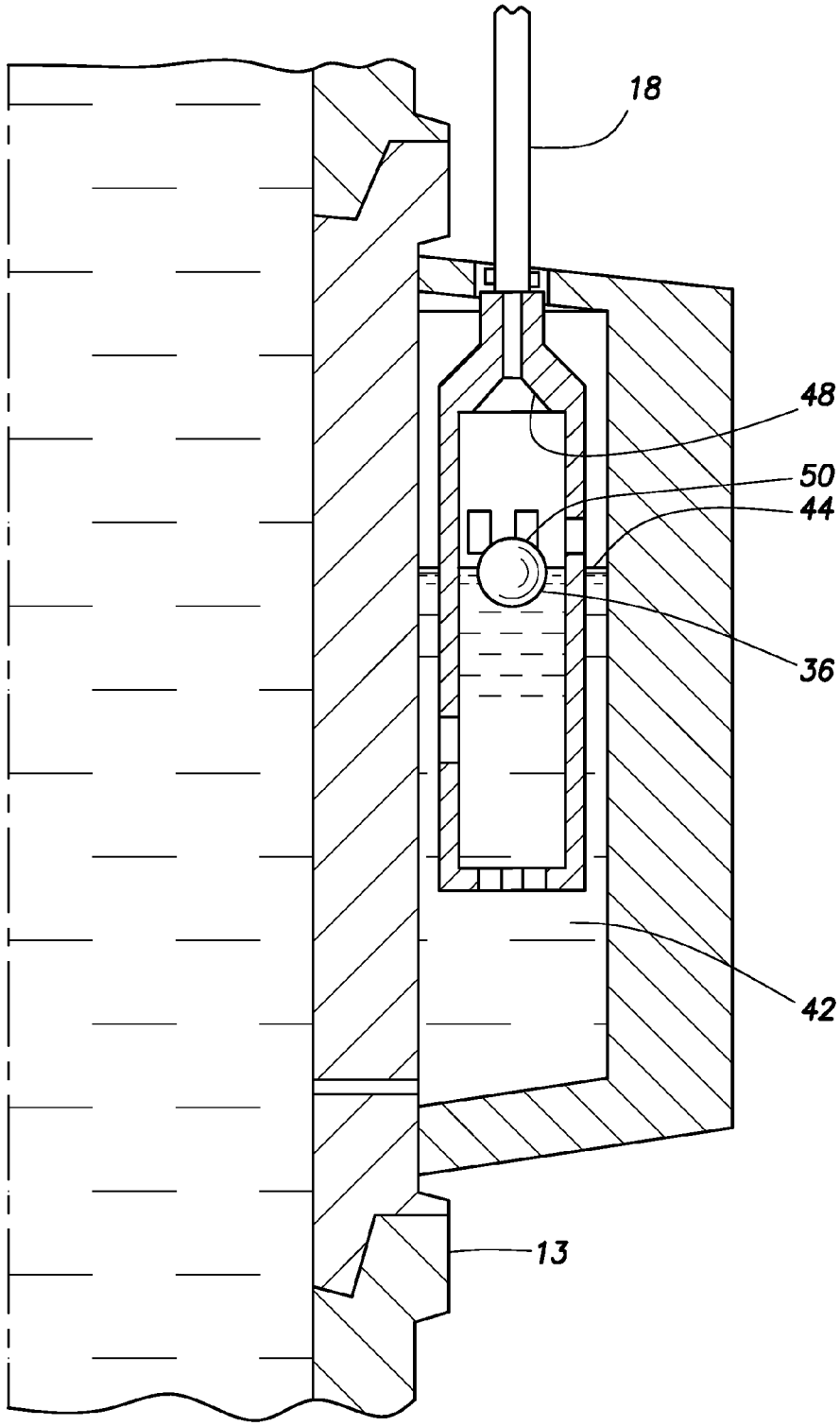
FIG. 3 is a cross-sectional view of the check valve assembly of FIG. 2 acted upon by an activating fluid.

In FIG. 3, the activating fluid 42 has contacted the operating member 36 and moved it towards the closed position 40. The activating fluid can be a liquid or gas, and, as shown here, can be a wellbore fluid, that is, fluid entering the pressure telemetry system from the wellbore, either from the casing annulus or the tubing interior. The activating fluid 42 creates an interface 44 with the monitoring gas 29. As the interface 44 rises and contacts the operating member 36, the operating member is moved upwards towards the closed position. The operating member floats on the activating fluid and its functioning is, therefore, not dependent on the velocity of activating fluid or monitoring gas. The check valve will close as the activating fluid moves upward through the check valve chamber, regardless of the velocity of the activating fluid.

Figure 4:
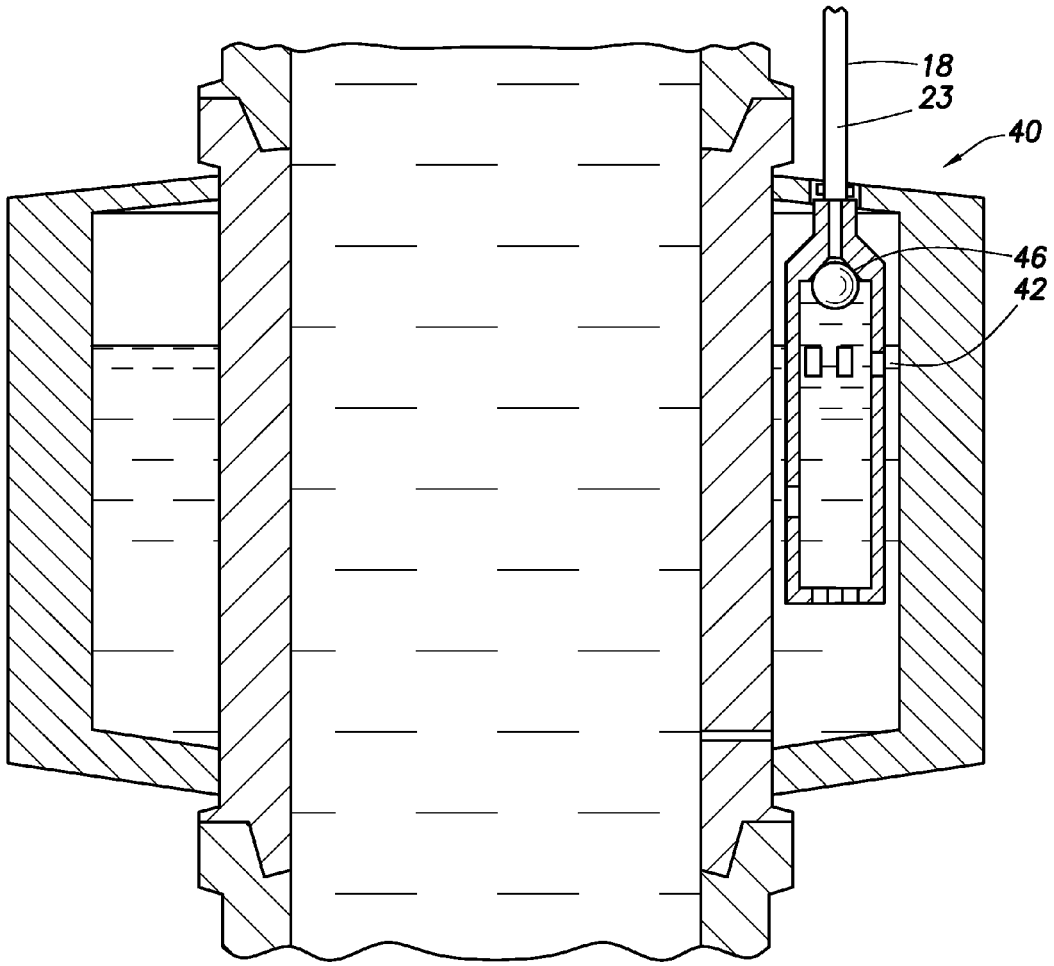
FIG. 4 is a cross-sectional view of the check valve assembly of FIG. 2 in a closed position.

In FIG. 4, the operating member 36 has floated and moved to a closed position 40 in which fluid flow is prevented past the seal 46. The seal 46 is created by contact between a sealing surface 48 of the check valve chamber interior and a sealing face 50 of the operating member 36. In the closed position 40, fluid flow is prevented between the wellbore 10 and the surface. The particular location of the seal 46 will depend on placement and design of the check valve assembly, but can be located anywhere along the flow path of the wellbore or activating fluid. The assembly can be located at the top of the monitoring-gas chamber, as shown, or at any other location within the chamber. Further, the assembly can be located at or near the monitoring-gas housing or at another location, such as above the housing along the flow path of the small diameter conduit.

If the check valve assembly 30 operates to block fluid flow to the surface, that is, the operating member moves to the closed position 40, the pressure telemetry system can be re-pressurized and placed back into service by purging the system. During purging, monitoring gas 29 is pressurized into the conduit 18 and through flow path 23. As the pressure of the monitoring gas 29 exceeds that of the activating fluid below the operating member 36, the operating member 36 is forced down out of the closed position 40 and the interface 44 of the activating fluid 42 and monitoring gas 29 is similarly forced downward. The monitoring-gas chamber and check valve assembly will return to the configuration shown in FIG. 3 as monitoring gas is pressurized into the system, and eventually will return to the configuration of FIG. 2.

To float on the activating fluid, the operating member, obviously, must have an effective specific gravity of less than the activating fluid. Since the activating fluid is often hydrocarbon liquid or gas, the effective specific gravity of the operating member must be very light. Typical wellbore fluids, such as hydrocarbon liquids and gases, have very low specific gravities. Hydrocarbon liquid, for example, may have a specific gravity in the range of about 0.8, while hydrocarbon gases have an even lower specific gravity. Although the operating member in FIGS. 2-4 is shown as a spherical object, it is unlikely that the operating member will be a solid since such a low specific gravity is needed for the operating member. A spherical or other shaped member can be used that houses a lighter gas, such as helium, in a hollow in the operating member, thereby lowering its effective specific gravity.

Figure 5:
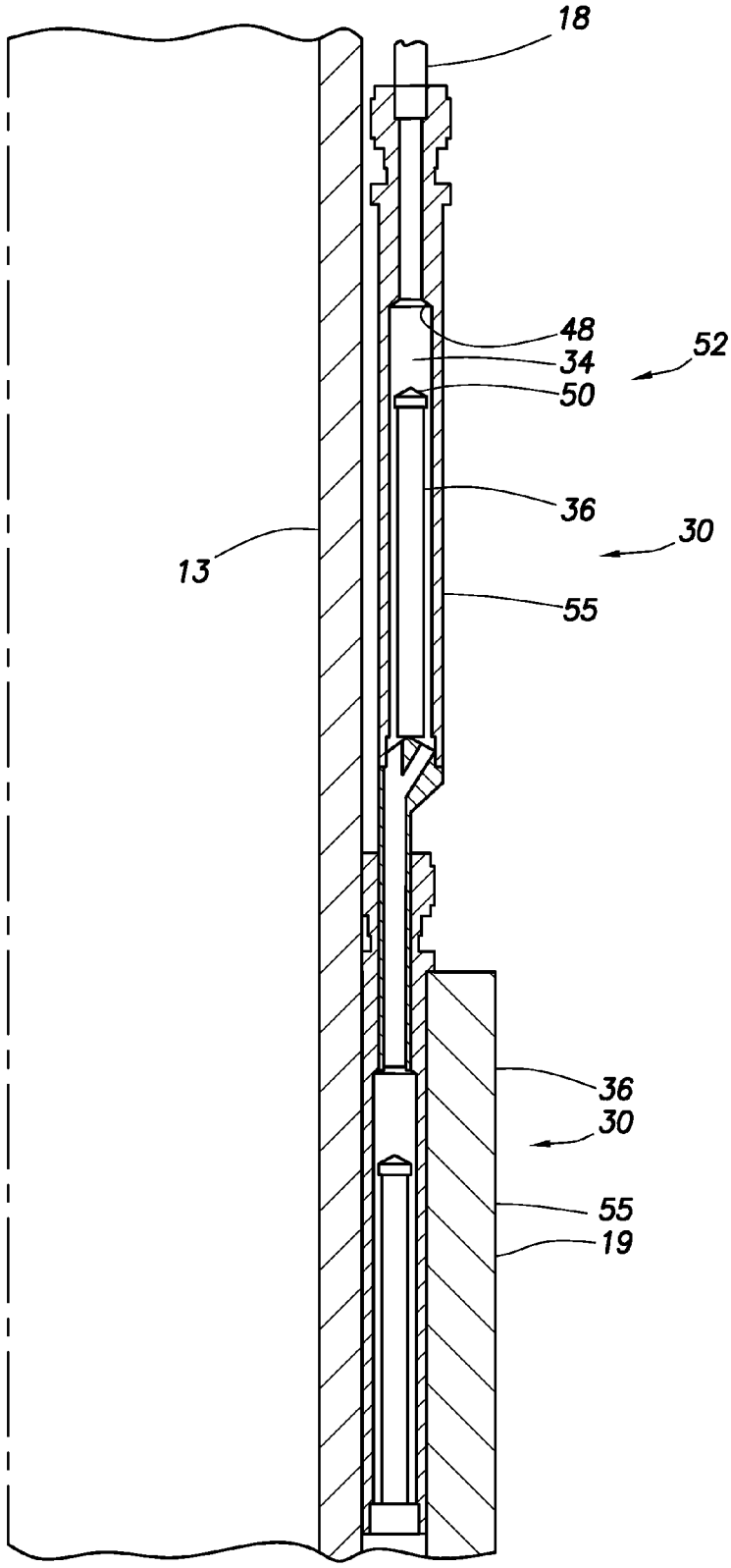
FIG. 5 is a cross-sectional view of two check valve assemblies of the invention.

FIG. 5 shows a cross-sectional view of a tubing 13 and two separate check valve assemblies 30. Multiple check valve assemblies 30 are not necessary but may be used. FIG. 5 shows that the assembly 30 may be built directly into the pressure monitoring-gas housing 19, as seen in the lower assembly 30 (and as seen in FIGS. 2-4). Alternately, the check valve assembly 30 may be manufactured in a unit 52 and retrofit onto an existing pressure telemetry system by placement of the check valve unit 52 above the monitoring-gas housing 19, as seen by the upper assembly 30 in FIG. 5. The unit 52 is preferably welded onto the upper end of the housing 19 in this embodiment. In yet another configuration, the check valve unit 52 can be placed further above the monitoring-gas housing 19 anywhere along the conduit 18. Placement of the check valve assembly 30 at or near the monitoring-gas housing 19 prevents the activating fluid 42 from flowing into the conduit 18 if the activating fluid pressure exceeds the monitoring gas pressure. This configuration reduces the likelihood that the activating fluid will foul the conduit. FIG. 5 shows the operating member 36 as a hollow dart 55, which will be explained in greater detail herein.

Figure 6:
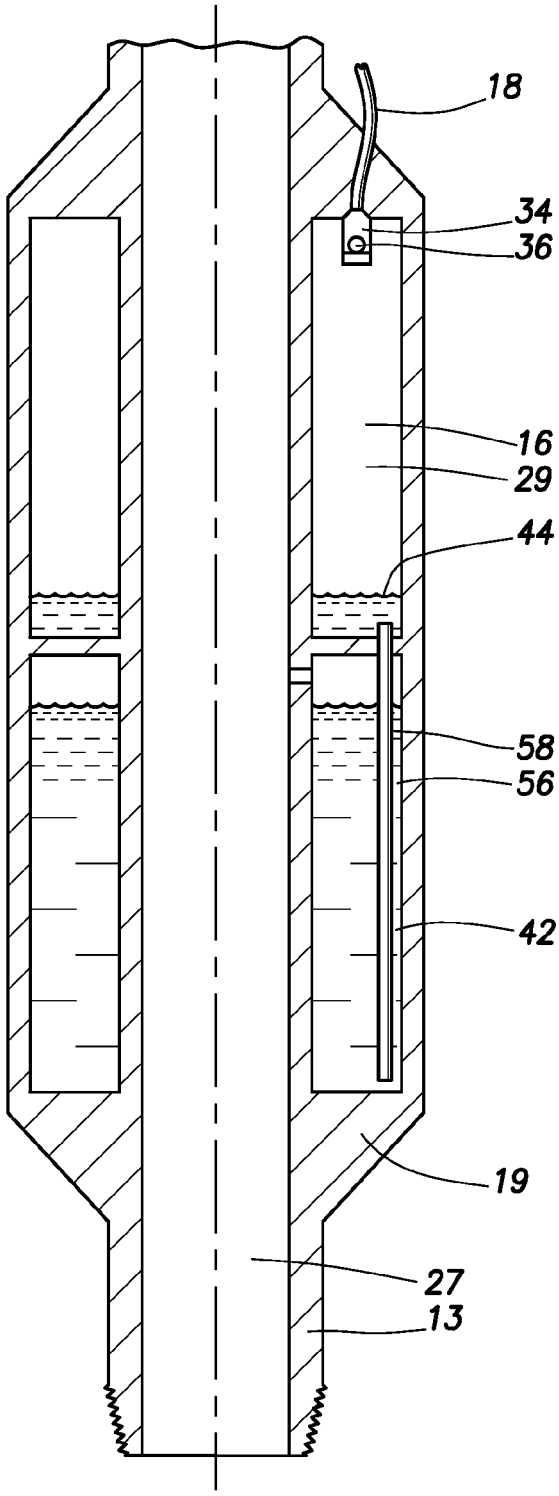
FIG. 6 is a cross-sectional view of a dual-chamber check valve assembly with an activating fluid chamber.

FIG. 6 shows a cross-sectional view of a dual-chamber housing which utilizes a pre-selected activating fluid to activate the check valve operating member rather than a wellbore fluid. In this embodiment, the housing 19 defines an upper monitoring-gas chamber 16 and a lower activating fluid chamber 56. The chambers 16 and 56 are in fluid communication with one another via communication tubing 58. The communication tubing 58 preferably extends from the lower end of the monitoring-gas chamber 16 to the lower end of the activating fluid chamber 54. Alternate arrangements of the chambers 16 and 54 are possible. The monitoring-gas chamber 16 houses the monitoring gas 29. The activating fluid chamber 54 houses activating fluid 42. The fluid 42 can be selected as desired but is heavier, or has a higher specific gravity, than the monitoring gas 29. Preferably the activating fluid 29 is also heavier than the wellbore fluids 27.

In this arrangement, if the wellbore fluid pressure exceeds the monitoring gas pressure, the wellbore fluid 27 forces the activating fluid 42 through communication tubing 58 into monitoring-gas chamber 16. The activating fluid 42 rises through the monitoring-gas chamber 16, into the check valve chamber 34 and contacts the operating member 36, moving the member 36 into the closed position. This arrangement has the advantage that the activating fluid 42 is pre-selected, having chosen characteristics, and is cleaner than typical wellbore fluid.

Figure 7:
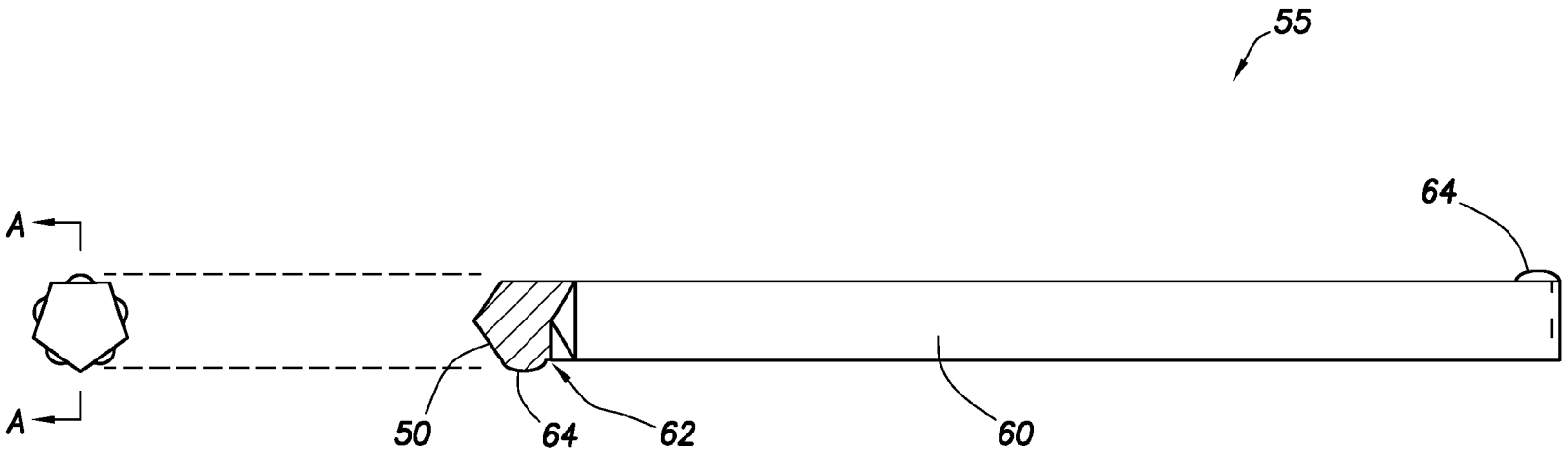
FIG. 7 is a cross-sectional view of an operating member dart of the check valve assembly.

FIG. 7 shows a cross-sectional view of a preferred operating member of the invention. The operating member 36 is preferably a hollow dart 55 defining a hollow portion 60. The hollow portion 60 is designed to retain a column of monitoring gas 29. As explained above, the effective specific gravity of the operating member must be lower than the specific gravity of the activating fluid if the operating member is to float on the activating fluid. In the dual-chamber arrangement shown in FIG. 6, a heavy activating fluid can be selected, having a high specific gravity. In that case, the operating member can simply be a solid shape and made of a material having a lower specific gravity than the activating fluid. In the single chamber design, however, the operating member must be designed to have a low effective specific gravity. Simultaneously, the operating member must be rugged enough to survive extreme downhole environments.

The dart 55 has a sealing face 50 which cooperates with a sealing surface in the check valve chamber. The sealing face 50 can be conical, as shown, spherical, flat or any desired shape. To prevent the dart 55 from sticking to the check valve housing inner wall, the dart 55 is preferably designed with an offset 62 formed by a standoff member 64. In FIG. 7, the dart 55 has a pentagonal standoff member 64 both near the top and at the bottom of the dart 55. The particular shape of the standoff member 64 is not critical and can be triangular or another shape, or can be bumps or other shapes extending from the surface of the dart 55. In FIG. 7, the pentagonal standoffs 64 are not aligned, as seen, to further limit the degree to which the dart 55 contacts the check valve chamber wall. The length of the dart 55 is selected to provide a hollow portion 60 volume sufficient to retain a selected volume of monitoring gas 29 to reduce the effective specific gravity of the dart 55 such that it will float on the activating fluid.

The dart can be made of any material, but is preferably made of a lightweight material capable of surviving in the downhole environment. Preferably the dart, or other shaped operating member, is made of PEEK. Alternate materials include, but are not limited to, polyethersulfone, acrylics, Vivac (tradename), polyethylenes, polypropylene, polysulfones, polyurethane and polyphenylene oxide. The dart or other operating member can be made partially or entirely of metal, ceramic or other substances. Metal may be desirable to form the sealing face of the operating member. The additional weight, and higher effective specific gravity, may require a greater hollow portion for retaining a greater volume of monitoring gas or use of the dual-chamber design. Similarly, if the activating fluid is a gas, the effective specific gravity of the operating member must be further reduced.

Figure 8:
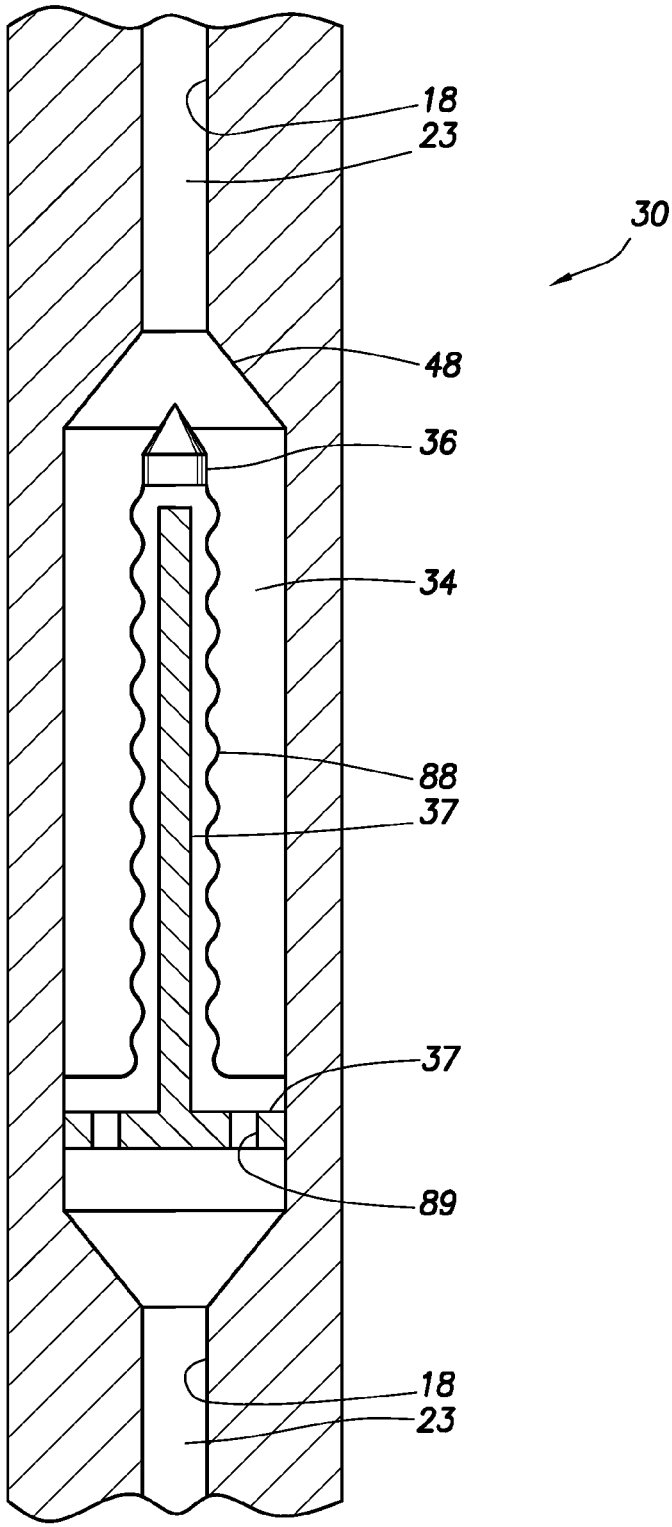
FIG. 8 is a cross-sectional view of a check valve assembly having a semi-permeable membrane.

FIG. 8 shows a cross-sectional view of a check valve assembly utilizing a semi-permeable membrane. Check valve assembly 30, in this case, is shown along fluid flow path 23 of conduit 18. The check valve chamber 34 houses a semi-permeable membrane 88. The membrane 88 is semi-permeable and selected based on the type of monitoring gas 29 and activating fluid 42 employed in the system. The semi-permeable membrane 88 allows the monitoring gas, such as helium, to diffuse through the membrane at a high rate. The membrane is impermeable or relatively impermeable to the activating fluid, such as hydrocarbon gas, which either cannot pass through the membrane or diffuses through only slowly. Semi-permeable membranes are commercially available from Air Products and Chemicals, Inc. Helium and nitrogen membranes are available. The membrane 88 creates a barrier across the check valve chamber 34. As the activating fluid 42 fills the check valve chamber 34 from below the membrane 88, a pressure differential is created across the membrane 88 and the membrane elongates, moving the operating member 36 upwards into a closed position in contact with the sealing surface 48.

The membrane 88 is preferably provided with "slack" such that the membrane can easily elongate to move the operating member into the closed position. In the embodiment in FIG. 8, the membrane 88 is attached to the operating member 36 and to the wall of the check valve chamber 34. Alternative arrangements are possible. For example, the operating member 36 can "ride" above the membrane, the membrane extending across the chamber 34 and attached only to the chamber wall. Alternately, the membrane can be attached to the retaining member rather than the chamber wall. The membrane can be fashioned in many different shapes to allow incorporation into various chamber designs. Other arrangements and embodiments will present themselves to those skilled in the art.

The retaining member 37 is provided with flow passages 89 therethrough. The retaining member 37 can be a disc with passages or a simple bar across the chamber 34. In the embodiment shown in FIG. 8, the retaining member also has an extension for supporting the operating member.

Figure 9B:
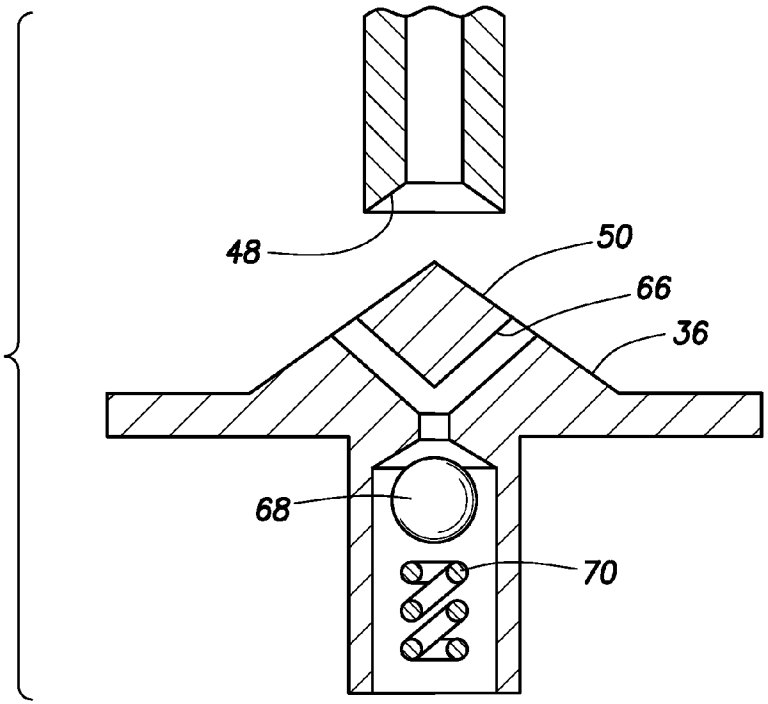
FIG. 9B is a cross-sectional view of a check valve dart having relief passages.
Figure 9A:
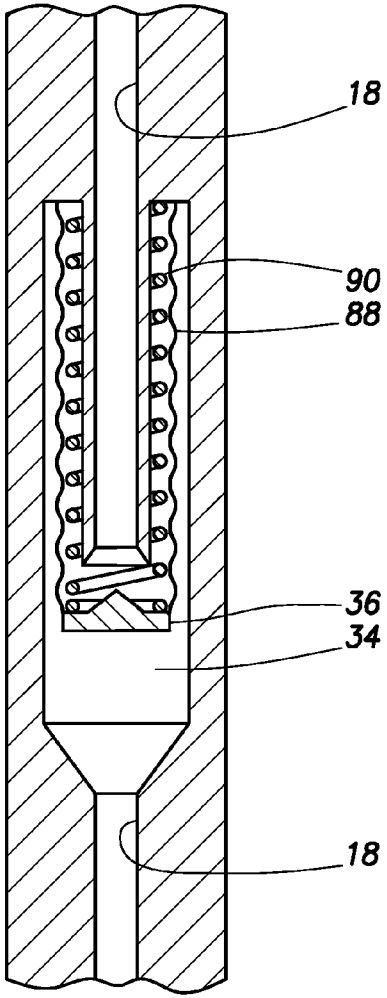
FIG. 9A is a cross-sectional view of a check valve assembly having a semi-permeable membrane and a biasing mechanism.

In FIG. 9A, a cross-sectional view of an alternate embodiment of the invention is shown using a semi-permeable membrane and a biasing mechanism. The biasing mechanism 90, such as a spring, is surrounded by the semi-permeable membrane 88 and biases the operating member towards the open position. In this embodiment, the activating gas 42 must create a pressure differential across the membrane 88 great enough to cause the membrane to compress the biasing mechanism 90. Further, the activating gas, in this embodiment, acts to condense or collapse the membrane rather than stretching it.

FIG. 9B presents a cross-sectional view of the operating member of the invention having pressure relief openings. To ease purging operations, which involve high gas flow rates, when the operating member 36 is in the open position, relief passages 66 are provided in the operating member 36. The pressure relief passages, obviously, cannot interfere with the sealing function of the sealing face 50. A pressure relief ball valve 68 is provided in the interior hollow portion 60 of the operating member. The ball valve 68 is biased toward a closed position by a biasing mechanism 90, such as a spring. The spring pressure is lower than the pressure required to burst the membrane 88 shown in FIG. 9 herein.

Figure 10:
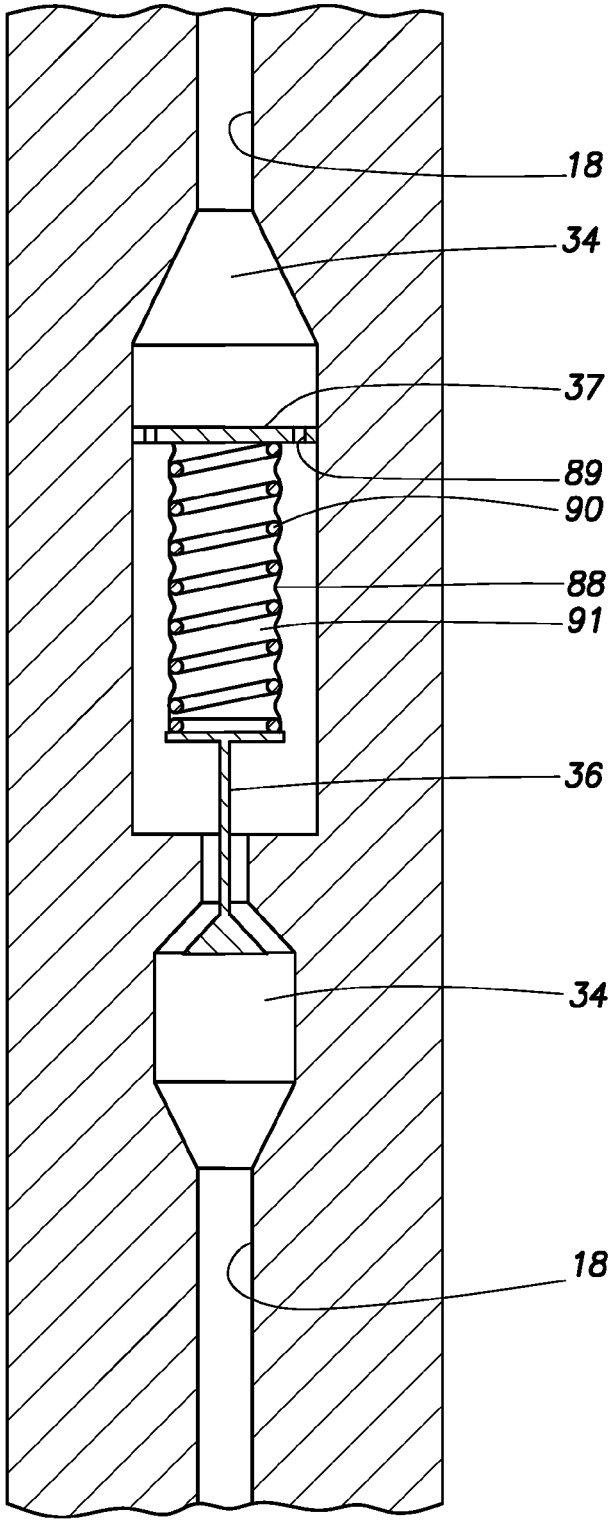
FIG. 10 is a cross-sectional view of a check valve assembly having a semi-permeable membrane balloon disposed in its chamber.

FIG. 10 presents a cross-sectional view of an embodiment of the invention having a semi-permeable membrane "balloon." The check valve chamber 34 houses a semi-permeable membrane "balloon." The membrane 88 creates an enclosed volume 91. The membrane can be attached to and supported from a retaining member 37 or can fully create the enclosed volume itself. In FIG. 10, the retaining member 37 has flow passages 89 allowing the monitoring gas and activating fluid to pass through. That is, the activating gas, upon entering the chamber 34 is free to surround the membrane balloon. During pressure changes in pressure within the telemetry system and during normal operation, the monitoring gas easily diffuses into and out of the membrane balloon. As the activating gas surrounds the balloon, the monitoring gas is free to diffuse through the membrane while the activating gas is not. The difference in diffusion rates results in the balloon contracting or deflating. The balloon pulls the operating member 36 into a closed position. In this case, the operating member is suspended below the balloon and cooperates with a sealing surface 48 created at a neck in the chamber 34. A biasing mechanism 90 can be provided, as shown. The biasing mechanism 90, such as a spring, can be located within the balloon volume 91 or outside the balloon. Where the biasing mechanism is present, the balloon contracts and compresses the biasing mechanism. Upon purging and re-establishment of the monitoring gas environment, the check valve will open and be held open by the biasing mechanism.

Other arrangements of the membrane balloon are possible. The balloon can be attached to the chamber wall or retaining member in various arrangements. Further, the biasing mechanism can be positioned inside or outside the balloon. Another biasing mechanism 90 can be supplied by using a stiffer membrane which can be folded, similar to an accordion. Other variations and arrangements will present themselves to those skilled in the art.

Figure 11:
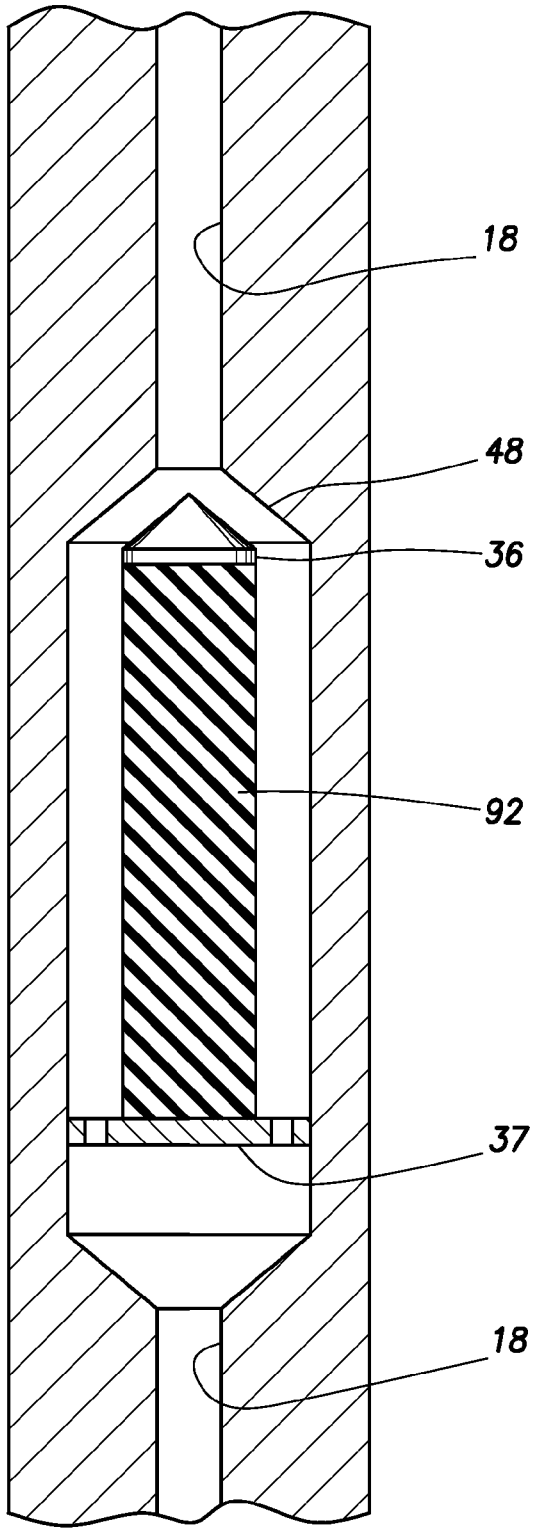
FIG. 11 is a cross-sectional view of a check valve assembly having a swellable dart disposed in its chamber.

FIG. 11 presents a cross-sectional view of a check valve assembly of the invention having a swellable material for moving the operating member of the valve. A swellable material forms a swellable member 92 which is disposed within the check valve chamber 34. The swellable member is made of a material which swells upon contact with the activating fluid 42. The activating fluid can, again, be wellbore fluids, liquid or gas, or a pre-selected fluid provided in a dual-chamber arrangement as in FIG. 6. As the swellable member expands, it forces the operating member into a closed position. The particular shape of the swellable member is not critical, although here it is shown as a dart. Preferably the swellable member is made of a material that will shrink back to or near its original shape once the activating fluid is removed from the chamber 34 during purging operations.

An example of a swellable material is a 50 duro nitrile with a low CAN content, or a soft EPDM. These substances will swell in the presence of hydrocarbons, so the activating fluid can be wellbore fluids. Further possible swellable materials include, but are not limited to, hydrogenated nitrile, polychloroprene, butyl, polyurethane and silicon, for instance, which swell in benzene. Similarly brake fluid will cause swelling of fluorocarbon, hifluor and flourosilicon, for example. Diesel will cause swelling of ethylene propylene, polyurethane, butyl, butadiene, isoprene and silicon, for example. Other swellable materials and activating fluids will present themselves to those skilled in the art.

The embodiments shown and described above are only exemplary. Many details are often found in the art such as screen or expansion cone configurations and materials. Therefore, many such details are neither shown nor described. It is not claimed that all of the details, parts, elements, or steps described and shown were invented herein. Even though, numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed:

1. Apparatus for continuously measuring pressure of a wellbore fluid in a wellbore at a downhole location, the apparatus comprising:

a conduit positioned in the wellbore and having a flow path extending from the surface to a downhole housing, the downhole housing defining a monitoring-gas chamber, the housing in fluid communication with the flow path in the conduit and with the wellbore, a pressurized monitoring-gas source for pressuring the flow path in the conduit and at least a portion of the monitoring-gas chamber with a selected monitoring gas, a check valve assembly having a check valve housing defining a check valve chamber, an operating member disposed within the check valve chamber, the operating member movable between an open position wherein fluid communication between the wellbore and the surface along the flow path of the conduit is allowed and a sealed position wherein fluid communication between the wellbore and the surface along the flow path of the conduit is prevented, the operating member movable to the sealed position by floating on an activating fluid.

2. An apparatus as in claim 1 wherein the activating fluid is a fluid selected from the group consisting of hydrocarbon wellbore liquid, hydrocarbon wellbore gas, completion liquid or gas, stimulation liquid or gas, an activating liquid placed in fluid communication with the check valve chamber, an activating gas placed in fluid communication with the check valve chamber and any mixture thereof.

3. An apparatus as in claim 1 wherein the operating member comprises a hollow portion for retaining a volume of the monitoring gas.

4. An apparatus as in claim 3 wherein the operating member is a hollow dart.

5. An apparatus as in claim 4 wherein the dart comprises at least a portion with a standoff member.

6. An apparatus as in claim 1 wherein the operating member comprises a sealing face and the check valve housing comprises a sealing surface, the sealing face and sealing surface cooperating to form a seal preventing fluid communication past the seal.

7. An apparatus as in claim 6 wherein the sealing face of the operating member is metal.

8. An apparatus as in claim 1 further comprising a retaining member for limiting movement of the operating member away from the sealed position.

9. An apparatus as in claim 1 wherein the activating fluid is stored in an activating fluid chamber in fluid communication with the check valve chamber.

10. An apparatus as in claim 1 wherein the operating member is biased toward the open position by gravity.

11. An apparatus as in claim 1 wherein the operating member is at least partially formed of PEEK.

12. An apparatus as in claim 1 wherein the check valve assembly is above the monitor-gas chamber and along the flow path of the conduit.

13. Apparatus for continuously measuring pressure of a wellbore fluid in a wellbore at a downhole location, the apparatus comprising:

a conduit positioned in the wellbore and having a flow path extending from the surface to a downhole housing, the downhole housing defining a monitoring-gas chamber, the housing in fluid communication with the flow path in the conduit and with the wellbore, a pressurized monitoring-gas source for pressuring the flow path in the conduit and at least a portion of the monitoring-gas chamber with a selected monitoring gas, a check valve assembly having a check valve housing defining a check valve chamber, an operating member disposed within the check valve chamber, the operating member movable between an open position wherein fluid communication between the wellbore and the surface along the flow path of the conduit is allowed and a sealed position wherein fluid communication between the wellbore and the surface along the flow path of the conduit is prevented, the check valve assembly having a semi-permeable membrane creating a barrier across the check valve chamber, the semi-permeable membrane substantially permeable to the monitoring gas and substantially impermeable to an activating fluid, the operating member movable to the sealed position when the membrane is contacted by the activating fluid.

14. An apparatus as in claim 13 wherein the activating fluid is a fluid selected from the group consisting of hydrocarbon wellbore liquid, hydrocarbon wellbore gas, completion liquid or gas, stimulation liquid or gas, a selected activating liquid or gas placed in an activating-fluid chamber positioned to be in fluid communication with the check valve chamber, and any mixture thereof.

15. An apparatus as in claim 13 wherein the operating member comprises a sealing face and the check valve housing comprises a sealing surface, the sealing face and sealing surface cooperating to form a seal preventing fluid communication past the seal.

16. An apparatus as in claim 13 further comprising a retaining member for limiting movement of the operating member away from the sealed position.

17. An apparatus as in claim 13 wherein the operating member is biased toward the open position by a spring.

18. An apparatus as in claim 13 wherein the semi-permeable membrane is helium permeable and substantially hydrocarbon gas impermeable.

19. An apparatus as in claim 17 wherein the spring is compressed by movement of the membrane when the membrane is acted upon by the activating fluid.

20. Apparatus for continuously measuring pressure of a wellbore fluid in a wellbore at a downhole location, the apparatus comprising:

a conduit positioned in the wellbore and having a flow path extending from the surface to a downhole housing, the downhole housing defining a monitoring-gas chamber, the housing in fluid communication with the flow path in the conduit and with the wellbore, a pressurized monitoring-gas source for pressuring the flow path in the conduit and at least a portion of the monitoring-gas chamber with a selected monitoring gas, a check valve assembly having a check valve housing defining a check valve chamber, an operating member disposed within the check valve chamber, the operating member movable between an open position wherein fluid communication between the wellbore and the surface along the flow path of the conduit is allowed and a sealed position wherein fluid communication between the wellbore and the surface along the flow path of the conduit is prevented, the check valve assembly having a semi-permeable membrane disposed within the check valve chamber, the semi-permeable membrane substantially permeable to the monitoring gas and substantially impermeable to an activating fluid, the semi-permeable membrane creating a closed volume, the operating member movable to the sealed position when the semi-permeable membrane is acted upon by an activating fluid.

21. An apparatus as in claim 20 wherein the operating member comprises a sealing face and the check valve housing comprises a sealing surface, the sealing face and sealing surface cooperating to form a seal preventing fluid communication past the seal.

22. An apparatus as in claim 20 further comprising a support member for suspending the semi-permeable membrane in the check valve chamber.

23. An apparatus as in claim 21 wherein the sealing face of the operating member and the sealing surface of the check valve chamber are disposed below the semi-permeable membrane.

24. An apparatus as in claim 20 wherein the semi-permeable membrane is helium permeable and substantially hydrocarbon gas impermeable.

25. An apparatus as in claim 20 wherein the check valve assembly further comprises a biasing mechanism, the biasing mechanism biasing the operating member toward the open position.

26. An apparatus as in claim 25 wherein the biasing mechanism is disposed within the volume created by the membrane.

27. An apparatus as in claim 25 wherein the biasing mechanism is compressed by movement of the membrane when the membrane is acted upon by the activating fluid.

28. Apparatus for continuously measuring pressure of a wellbore fluid in a wellbore at a downhole location, the apparatus comprising:

a conduit positioned in the wellbore and having a flow path extending from the surface to a downhole housing, the downhole housing defining a monitoring-gas chamber, the housing in fluid communication with the flow path in the conduit and with the wellbore, a pressurized monitoring-gas source for pressuring the flow path in the conduit and at least a portion of the monitoring-gas chamber with a selected monitoring gas, a check valve assembly having a check valve housing defining a check valve chamber, an operating member disposed within the check valve chamber, the operating member movable between an open position wherein fluid communication between the wellbore and the surface along the flow path of the conduit is allowed and a sealed position wherein fluid communication between the wellbore and the surface along the flow path of the conduit is prevented, the operating member movable to the sealed position by a swellable material, the swellable material substantially swelling when exposed to an activating fluid.

29. An apparatus as in claim 28 wherein the swellable material is a 50 duro nitrile with a low ACN content.

30. An apparatus as in claim 28 wherein the material is expandable in the presence of hydrocarbon fluid and returns substantially to its unexpanded state when removed from the presence of activating fluid.

31. An apparatus as in claim 28 wherein the activating fluid is stored in an activating fluid chamber in fluid communication with the check valve chamber.

* * * * *